US005692407A

United States Patent [19]

Kajiwara et al.

[11] Patent Number: 5,692,407

[45] Date of Patent: Dec. 2, 1997

[54] SHAPE CONTROL IN A STRIP ROLLING MILL OF CLUSTER TYPE

[75] Inventors: Toshiyuki Kajiwara, Hitachi; Kenichi Koyama, Takahagi; Hidetoshi Nishi, Hitachi; Tetsuji Taniguchi, Chofu; Isao Asotani, Kasukabe, all of Japan

[73] Assignee: Hitachi, Ltd., Tokyo, Japan

[21] Appl. No.: 225,432

[22] Filed: Apr. 8, 1994

Related U.S. Application Data

[63] Continuation of Ser. No. 908,809, Jul. 7, 1992, abandoned, which is a continuation of Ser. No. 758,114, Sep. 12, 1991, abandoned.

[30] Foreign Application Priority Data

Sep. 19, 1990 [JP] Japan ..... 2-247590

[51] Int. Cl.[6] ..... B21B 29/00

[52] U.S. Cl. ..... 72/241.4; 72/10.4; 72/13.6; 72/20.3; 72/242.4

[58] Field of Search ..... 72/12, 21, 241.4, 72/241.6, 242.2, 242.4, 248, 10.1, 10.4, 13.4, 13.5, 13.6, 20.1, 20.2, 20.3

[56] References Cited

U.S. PATENT DOCUMENTS

| | | | |
|---|---|---|---|
| 2,169,711 | 8/1939 | Sendzimir . | |
| 3,147,648 | 9/1964 | Sendzimir . | |
| 3,528,274 | 9/1970 | Rastelli . | |
| 3,587,279 | 6/1971 | Sendzimir et al. | 72/248 |
| 3,858,424 | 1/1975 | Kajiwara et al. | 72/242.4 |
| 4,022,040 | 5/1977 | Turley | 72/10 |
| 4,289,013 | 9/1981 | Hunke | 72/241.6 |

FOREIGN PATENT DOCUMENTS

| | | | |
|---|---|---|---|
| 3537153 | 5/1987 | Germany | 72/241.6 |
| 0055111 | 4/1983 | Japan | 72/21 |
| 0173006 | 10/1983 | Japan | 72/242.4 |
| 0108401 | 4/1990 | Japan | 72/242.4 |

OTHER PUBLICATIONS

A paper "Lubrication of Sendzimir Mills" by L. R. Seeling, 3rd Annual Meeting of the Lubrication and Wear Group, 1964 (Institution of Mechanical Engineers, London).

*Primary Examiner*—Lowell A. Larson
*Assistant Examiner*—Ed Tolan
*Attorney, Agent, or Firm*—Evenson McKeown Edwards & Lenahan, PLLC

[57] ABSTRACT

A strip rolling mill of cluster type has, on at least one side of the strip path, a work roll, a plurality of intermediate rolls supporting said work roll and a plurality of backing bearing assemblies supporting said intermediate rolls. Each backing bearing assembly has a row of backing bearing units and shape control means by which the backing bearing units are adjustable relative to the work roll axis so that strip shape control can be applied. All backing bearing assemblies on one side of the strip path have such shape control means. In the mill at least two of the shape control means are independently operable so as to apply respectively different shape control patterns to the work roll.

28 Claims, 15 Drawing Sheets

SHAPE CONTROL IN A STRIP ROLLING MILL OF CLUSTER TYPE

This is a Continuation application of Ser. No. 07/908,809, filed Jul. 7, 1992 abandoned, which is a Continuation application of Ser. No. 07/758,114, filed on Sep. 12, 1991, now abandoned.

BACKGROUND OF THE INVENTION

1. Field of the invention

This invention relates to strip rolling mills of the cluster type, such as Sendzimir mills, and is particularly concerned with the shape control of the strip. In this specification, the term strip is used to describe the metal workpiece which passes through such a mill, although in this art various other terms are also employed. The present invention is concerned with control of the shape of the strip, mainly the flatness of the strip and also cross-sectional shape.

2. Description of the prior art

For the cold rolling of thin hard material such as stainless steel, silicon steel, high nickel alloys and other material such as copper and copper alloys, work rolls of small diameter are required. To meet this requirement, multi-roll cluster rolling mills were developed many years ago, the primary example being the Sendzimir mill. In cluster mills, on each side of the strip path the work roll is supported by two intermediate rolls, which in turn are each supported either by two intermediate rolls or two backing bearing assemblies. Typically, a so-called twelve high mill has on each side of the strip path a work roll, two intermediate rolls and three backing bearing assemblies, while a twenty high mill has a work roll, two first intermediate rolls, three second intermediate rolls and four backing bearing assemblies. Although more complex in construction, the twenty high mill is advantageous from the point of view of reduction of diameter of the work roll, while keeping the rolling torque transmission capability necessary for wide strip rolling. Rolling torque can be fed through the second intermediate rolls, which is more advantageous than through the first intermediate rolls which is necessary in a twelve high mill. This is because the driving spindle diameter can be bigger at the second intermediate roll than at the first intermediate roll. From the point of view of surface quality of the products, the twenty high mill is also superior, since the tendency for so-called bearing marks to be transferred from the backing bearings through the intermediate rolls to the work roll and thus to the rolled strip can be much reduced.

When work rolls of small diameter are used, the rigidity of the work roll is low, so that it is liable to bend under the rolling forces in a complicated manner. There have therefore been developed strip shape adjustment systems which can apply roll bending through the backing bearings, by adjusting the position of the various backing bearing units along a row of them. Such adjustment systems have come to be known as AS-U devices, and can be operated during rolling to effect shape adjustment.

U.S. Pat. No. 2,169,711 is an early disclosure of such adjustment of the backing bearings, to apply bending to the work rolls, by individually adjusting the position of the backing bearing units which are arranged in a row along a shaft of the backing bearing assembly while each being supported against the mill housing by a saddle. By means of members mounted eccentrically with respect to the shaft, the support position of each backing bearing unit can be adjusted, by rotating the eccentric member relative to the shaft. U.S. Pat. No. 2,169,711 shows a twelve high mill, and it is mentioned that this adjustment system, operable during rolling by the mill, can be applied to at least one of the series of the backing bearing rollers. A twenty high mill and a six high mill are also briefly referred to.

The adjustment of shape control, during rolling, using the adjustment of the backing bearings just described is separate from the adjustment of the backing bearing assembly as a whole, often known as "screwdown" control, which is used when the strip thickness is changed, when the work roll size is changed or as the intermediate rolls wear. This screwdown control typically also employs other eccentric support members fixed onto the shaft of the backing bearing assembly.

U.S. Pat. No. 3,147,648 is concerned primarily with a cartridge system for insertion and removal of the rolls, but also mentions the control means for the crown, contour or flatness of the workpiece. The system employed is similar to that already described, involving eccentric rings controlling the exact position of each portion of the shaft of the backing bearing assembly. It is mentioned that this control means may be provided on any one or all of the shafts, and in the preferred embodiment only the upper two shafts, among the four shafts in the upper part of the mill, are provided with this control. The shape control adjustment of the two shafts is effected simultaneously, through a single control means which operates equally on the respective eccentrics for corresponding backing bearing units on the two adjacent shafts.

U.S. Pat. No. 3,528,274, which describes a one-two-one-four type of Sendzimir mill employing only a single second intermediate roll, also mentions that each backing bearing assembly may have eccentric rings mounted on the shaft, such that different configurations of the work roll may be obtained. It is mentioned that by adjusting individual ones of the bearing shafts or by combinations of the shafts, various strip shapes are possible. U.S. Pat. No. 4,289,013 shows crown control adjustment operating on the two top backing elements of a twenty high mill, these two backing assemblies having crown control applied to them in conjunction and not individually.

A paper "Lubrication of Sendzimir Mills" by L. R. Seeling, 3rd annual meeting of the Lubrication and Wear Group, 1964 (Institution of Mechanical Engineers, London) describes shape control by eccentric adjustment of the backing bearings of the outermost two backing bearing assemblies in the strip path direction, rather than the two topmost bearing assemblies as mentioned above. A rolling mill embodying this concept is manufactured by Kobe Steel Limited and is in the form of a twenty high mill or a twelve high mill. The two backing bearing assemblies are adjusted in concert, i.e. not independently, to effect shape control.

The prior art can be summarized in that, although certain entirely general proposals have been made as to applying shape control adjustment to more than two of the backing bearing assemblies, the purpose or effect of this is not discussed, and in practice such shape control adjustment capability has been applied in Sendzimir mills only to two of the backing bearing assemblies, i.e. either the top two backing bearing assemblies or the outermost two backing bearing assemblies above the strip path, and the two backing bearing assemblies have not been independently adjusted for strip shape control.

Although the problems of work roll bending and bearing mark transfer are partially solved by the measures described above, the present invention is based on the concept that further improvements in the solution of these problems can be obtained.

SUMMARY OF THE INVENTION

An object of the invention is to provide a strip rolling mill of the cluster type in which improved shape control can be applied to the work roll.

A further object of the invention is to provide a strip rolling mill of cluster type in which the tendency for bearing marking to transfer to the strip is decreased.

In one broad aspect, the present invention lies in the concept of applying different shape control patterns to the work roll by independent adjustment of the shape control means of at least two backing bearing assemblies. This permits a wider range of overall shape control of the work roll, and better fitting of the overall shape control pattern to the ideal. As explained below, the effect of applying two different shape control patterns using two independently adjustable backing bearing assemblies can be greater than twice the effect of using a single backing bearing assembly.

In another aspect, the invention provides the concept of providing all of the backing bearing assemblies on at least one side of the strip path with shape control means, and preferably providing also at least some of the backing bearing assemblies on the other side of the strip path with shape control means. These shape control means can be all controlled independently, or at least one adjacent pair may be controlled in conjunction, as illustrated below.

Different shape control patterns may be applied by two backing assemblies which are on the same side of the mill center plane or on opposite sides of the mill center plane. The mill center plane is a term used herein to mean the plane common to the two work roll axes, which is usually the central vertical plane.

In another aspect, this invention provides a mill in which the backing bearing units of the adjacent backing bearing assemblies are staggered axially. This enables finer control of the shape control pattern applied to the work roll, with reduced risk of bearing mark transfer to the rolled strip.

In more detail in the rolling mills of the invention, each backing bearing in all the backing bearing assemblies at one side of the strip path may be provided with a control device for individually regulating the support position of the backing bearings, and therefore the strip shape can be controlled in all rows, corresponding to the rolling load distributed in all rows of the backing bearing devices, and the strip shape control capacity of the entire rolling mill is synergistically improved, thereby realizing a mill possessing a shape control capability extended both quantitatively and qualitatively.

Furthermore, at one side of the strip path, each backing bearing in all backing bearing assemblies may be provided with a control device for individually regulating the support position of backing bearings, and therefore the shape adjustment capability limit due to backing bearing pitch can be decreased and the shape control can be adjusted at a more appropriate position, thereby realizing a rolling mill capable of obtaining a favorable shape control performance.

BRIEF INTRODUCTION OF THE DRAWINGS

Embodiments of the invention will now be described by way of non limitative example, with reference to the accompanying drawings in which.

Figure 8B:
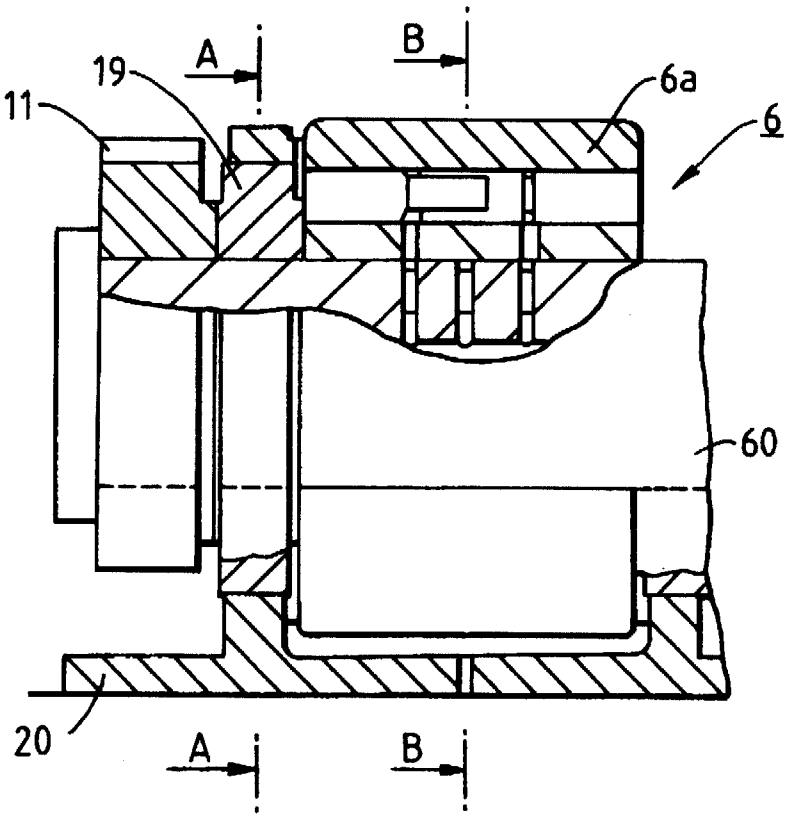
Figure 8A:
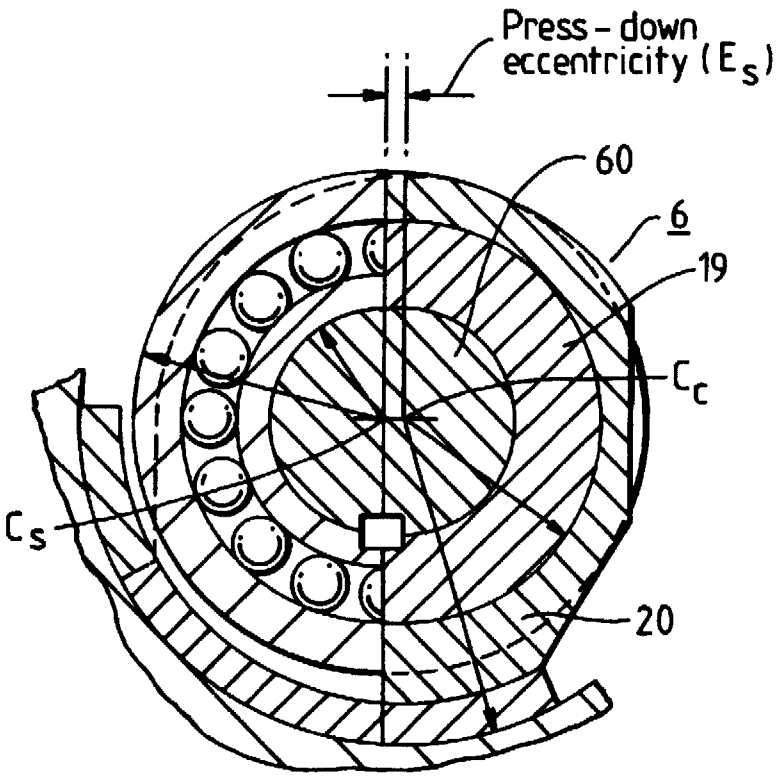
Figure 9B:
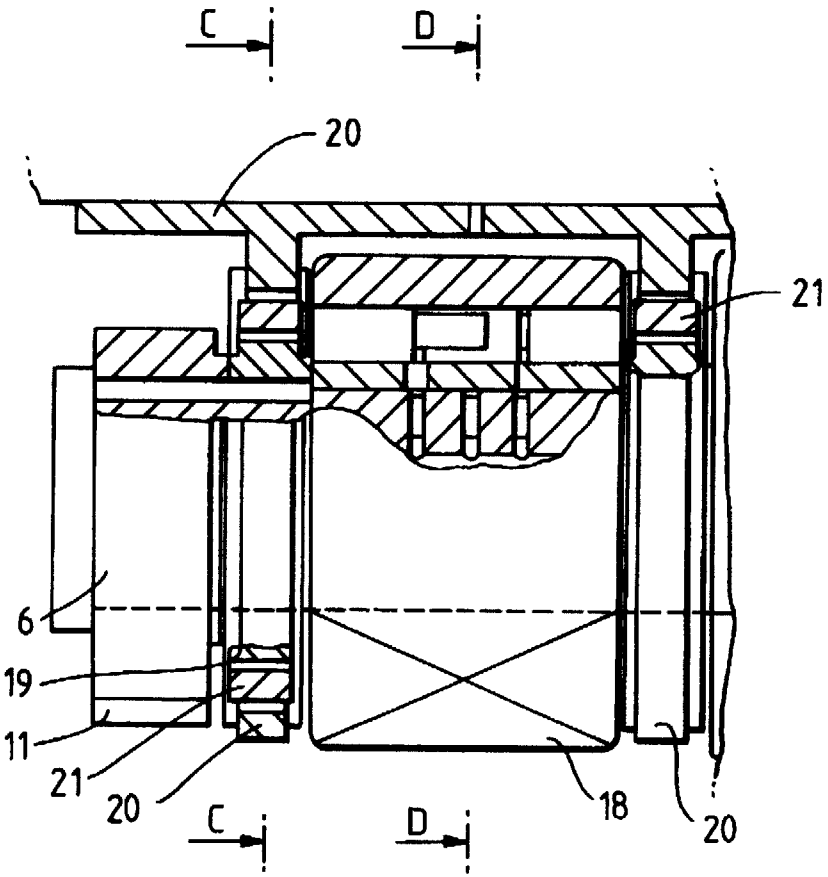
Figure 9A:
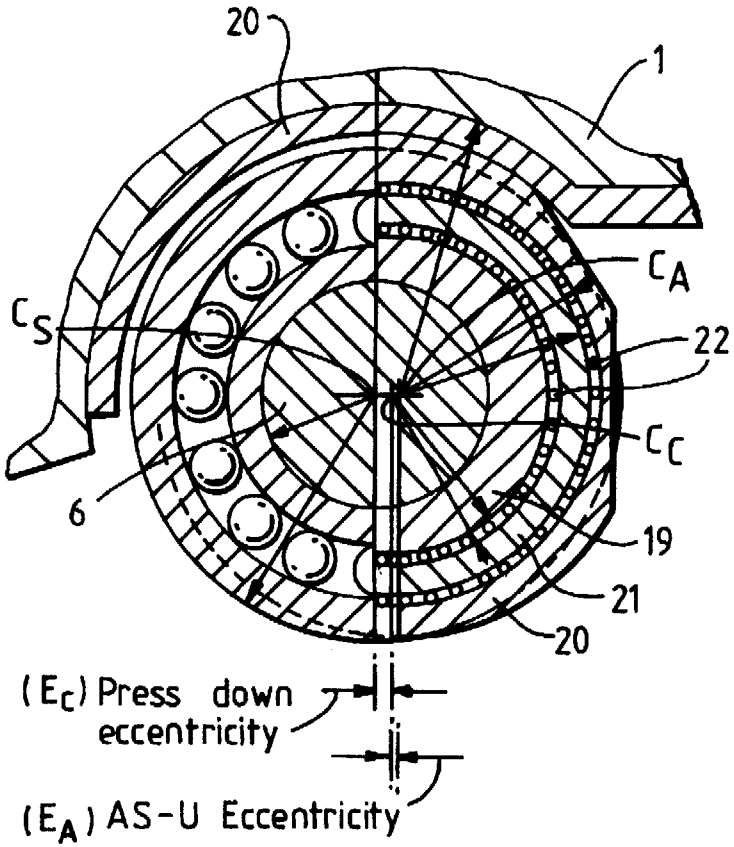
Figure 10:
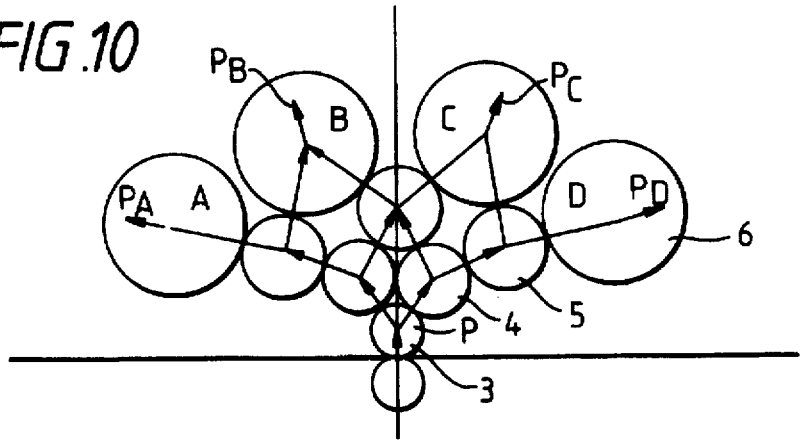
Figure 11:
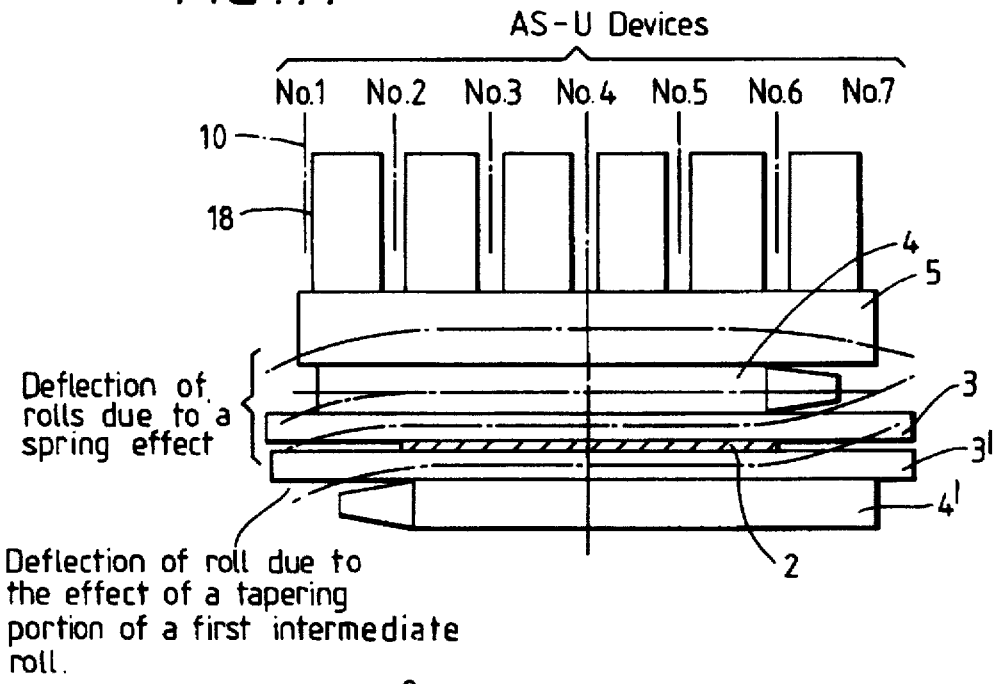
Figure 12:
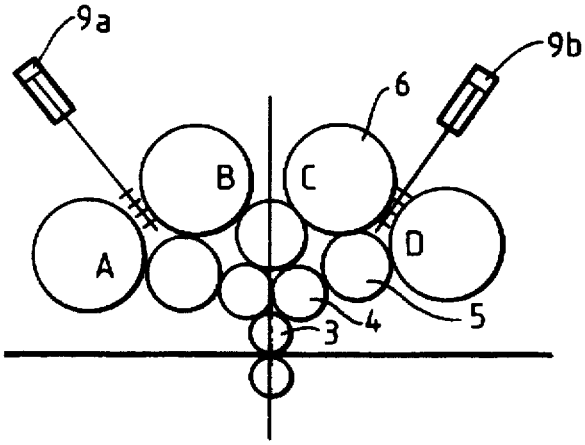
Figure 13:
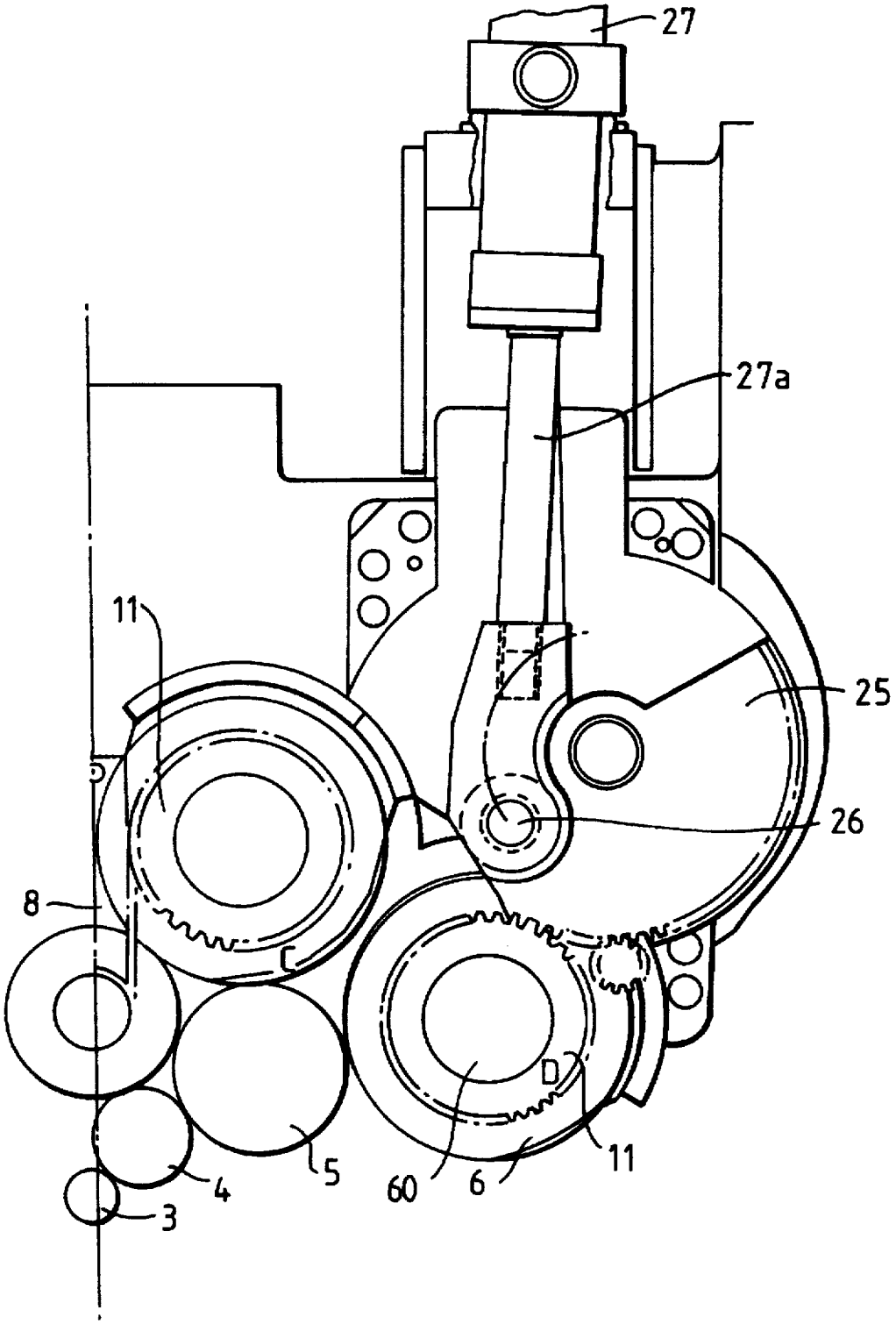
Figure 14:
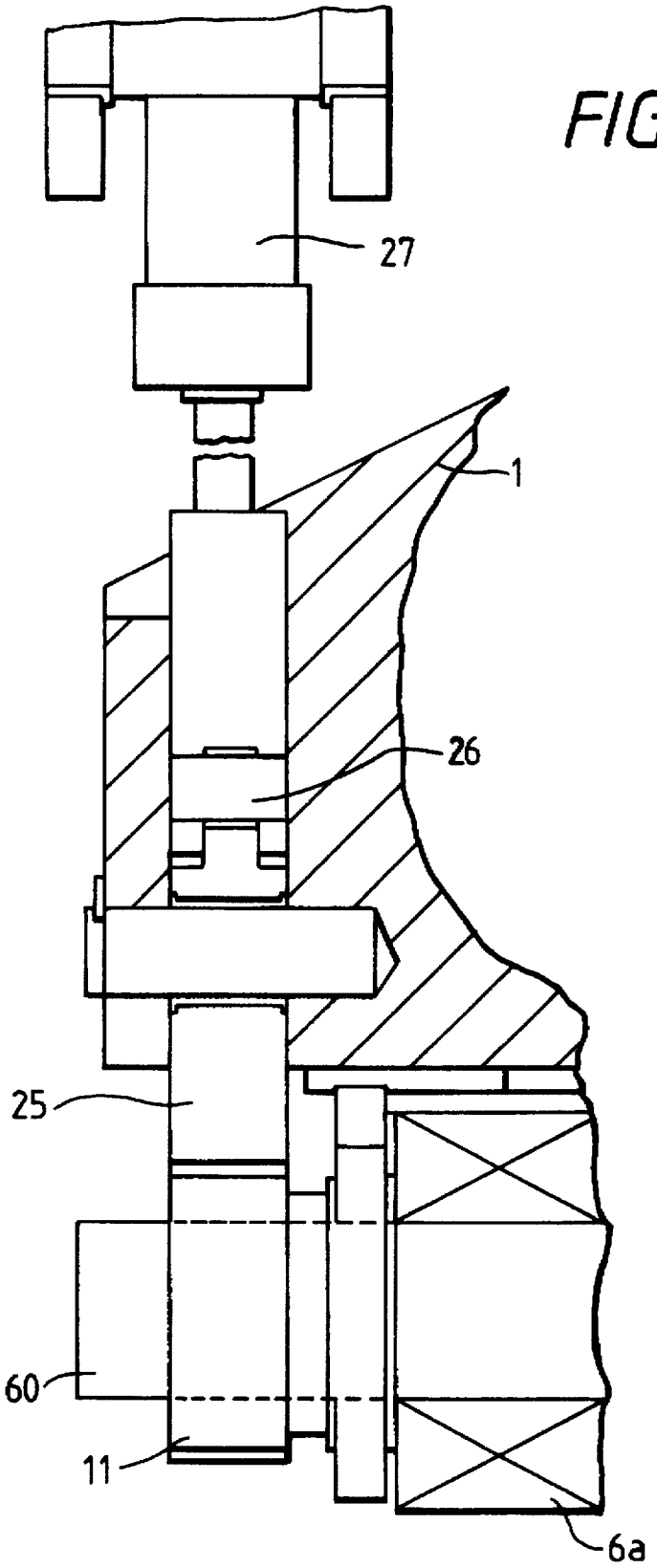
Figure 15A:
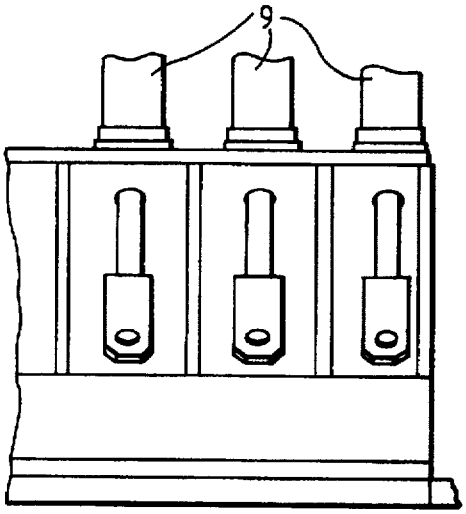
Figure 15B:
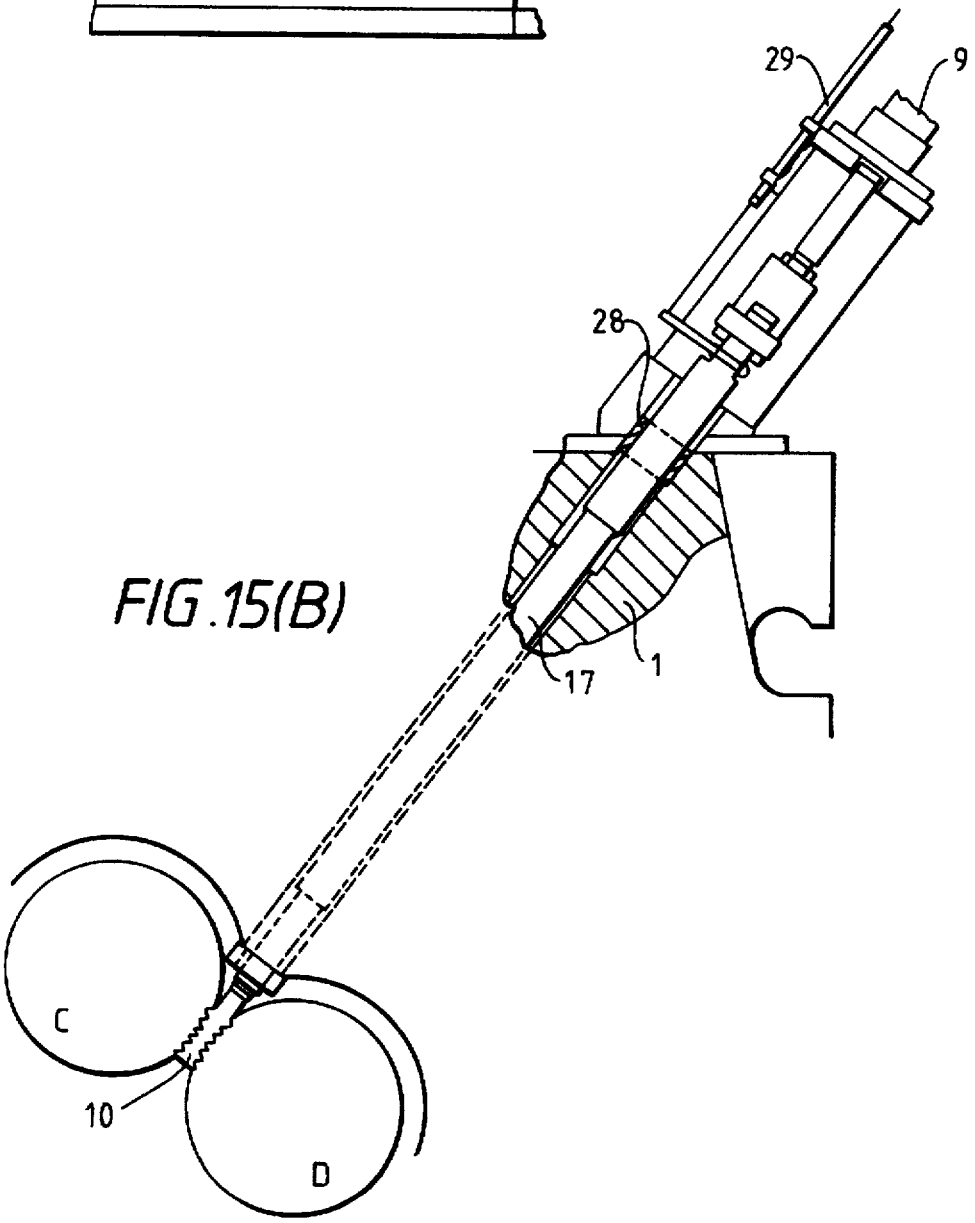
Figure 16:
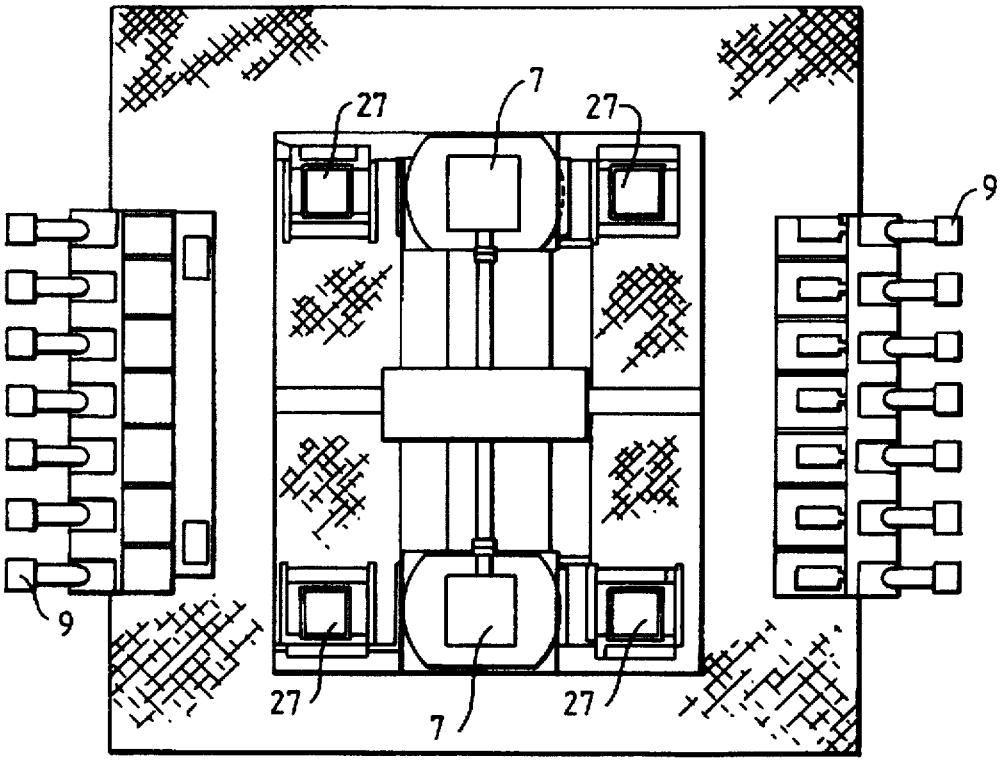
Figure 17:
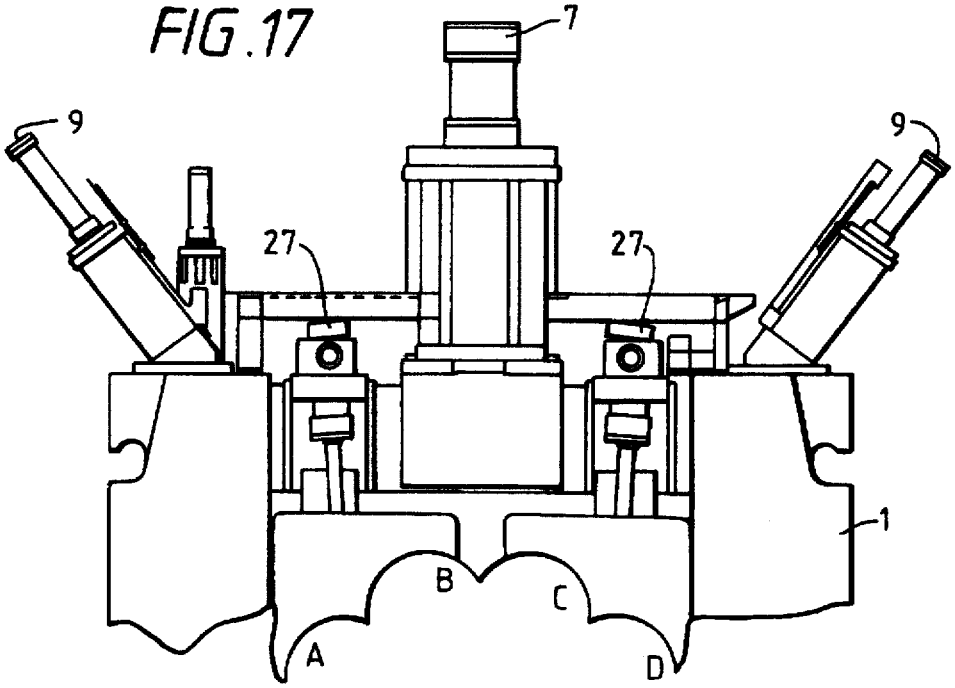
Figures 18A, 18B:
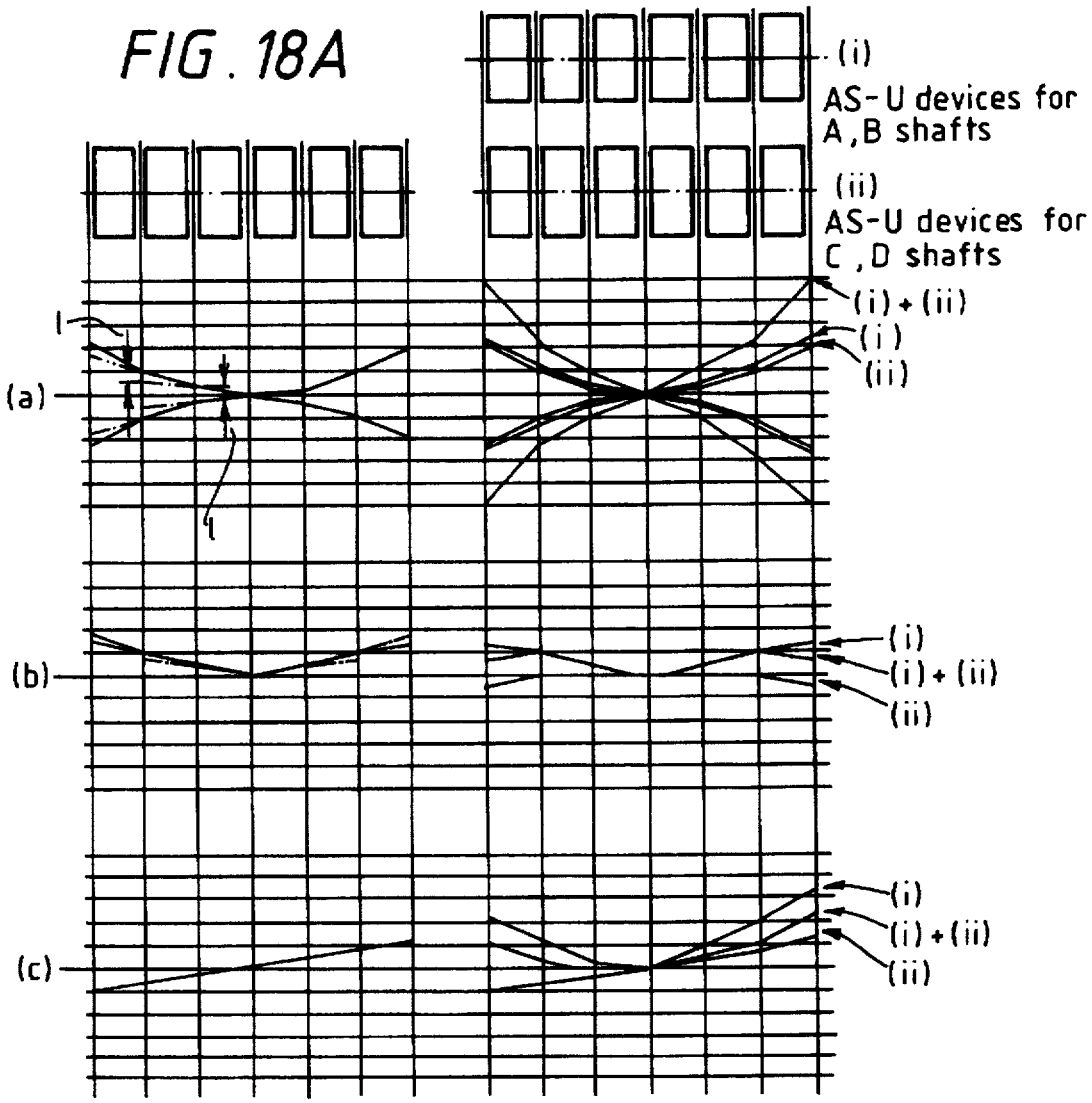
Figure 19:
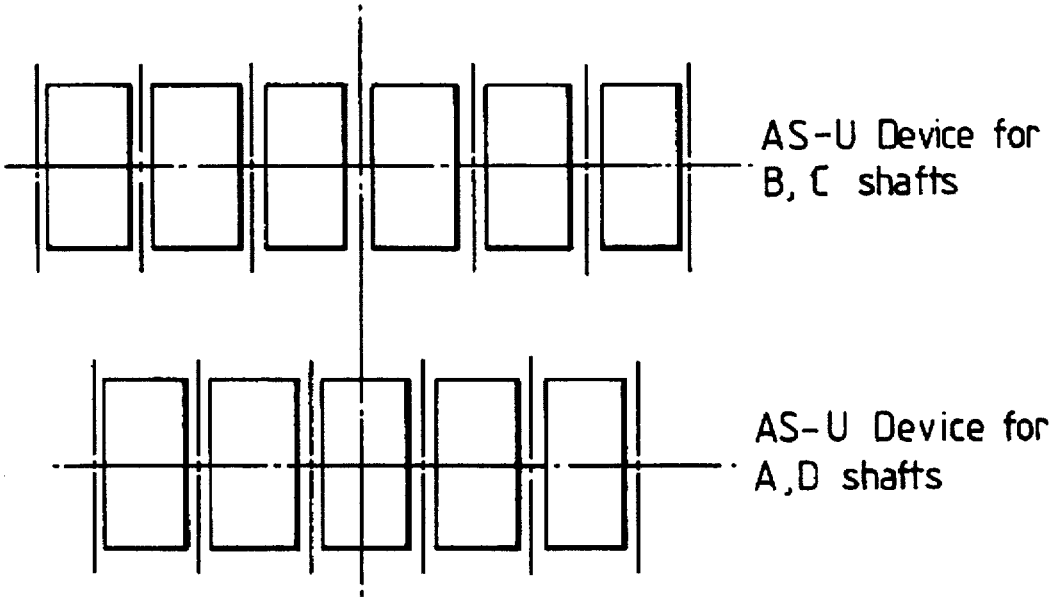
Figure 19:
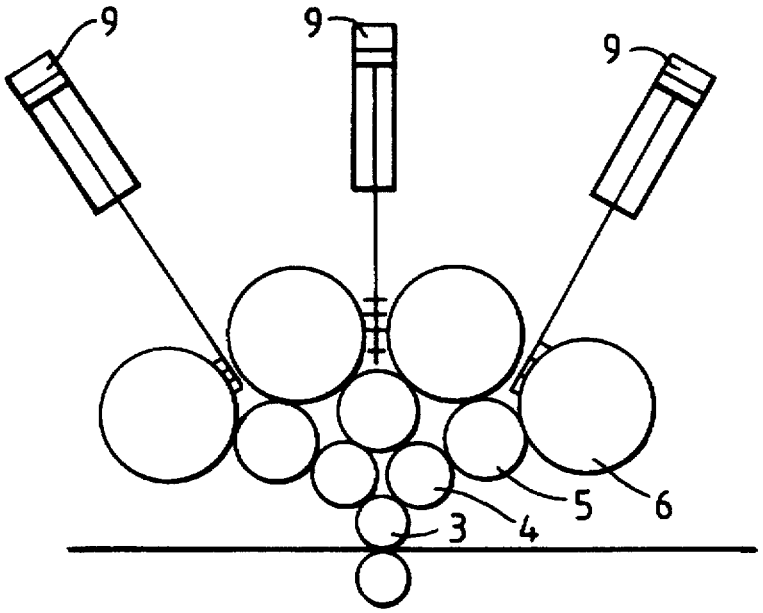

FIGS. 8(A) and 8(B) are sectional views of backing bearing for screwdown with FIG. 8(A) showing two sections, on opposite side of the vertical center line, respectively at lines A—A and B—B in FIG. 8(B) illustrating a single eccentric adjustment mechanism;

FIGS. 9(A) and 9(B) illustrate further details of the shape control adjustment mechanism in a Sendzimir mill, to which the invention is applied, FIG. 9(A) being two sections, on opposite sides of the vertical center line of the figure, corresponding respectively to section lines C—C and D—D of FIG. 9(B);

FIG. 10 is a diagrammatic side view of a Sendzimir mill showing the rolling force paths;

FIG. 11 is a diagrammatic vertical section in the mill centre plane showing roll deflection effects;

FIG. 12 is a diagrammatic side view of another Sendzimir mill embodying the invention;

FIG. 13 illustrates in side view a braking device of a backing bearing assembly adjustment mechanism embodying the invention;

FIG. 14 is a vertical section of the apparatus shown in FIG. 13 in which the pin 26 is rotated to its top position;

FIGS. 15(A) and 15(B) illustrate diagrammatically backing bearing assembly adjustment mechanisms applied to the outermost backing bearing assemblies on a Sendzimir mill, in accordance with the invention;

FIG. 16 is a top view of the mill partly shown in FIG. 15;

FIG. 17 is a diagrammatic side view of the mill of FIG. 16;

FIGS. 18(A) and 18(B) illustrate the shape control patterns which can be obtained in embodiments of the present invention and a comparative mill; and FIG. 19 diagrammatically illustrates another embodiment of the invention.

PREFERRED EMBODIMENTS OF THE INVENTION

Figure 1:
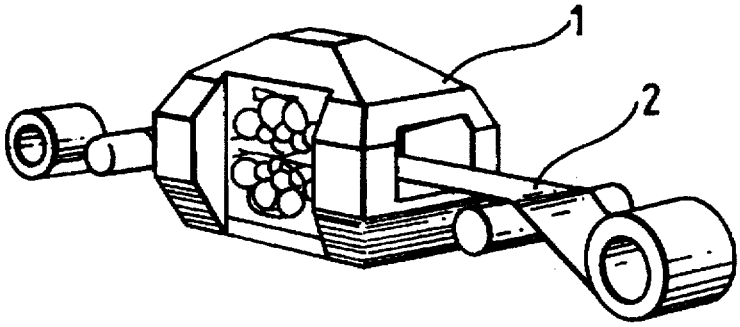
FIG. 1 is a general schematic perspective view of a Sendzimir strip rolling mill, to which the invention can be applied.

FIG. 1 of the accompanying drawings shows the housing 1 of a Sendzimir strip rolling mill, through which passes a strip 2 from an uncoiler to a coiler. In the mill, there is a cluster of rolls including work rolls which act upon the strip 2. These rolls are illustrated and described more below.

Figure 2:
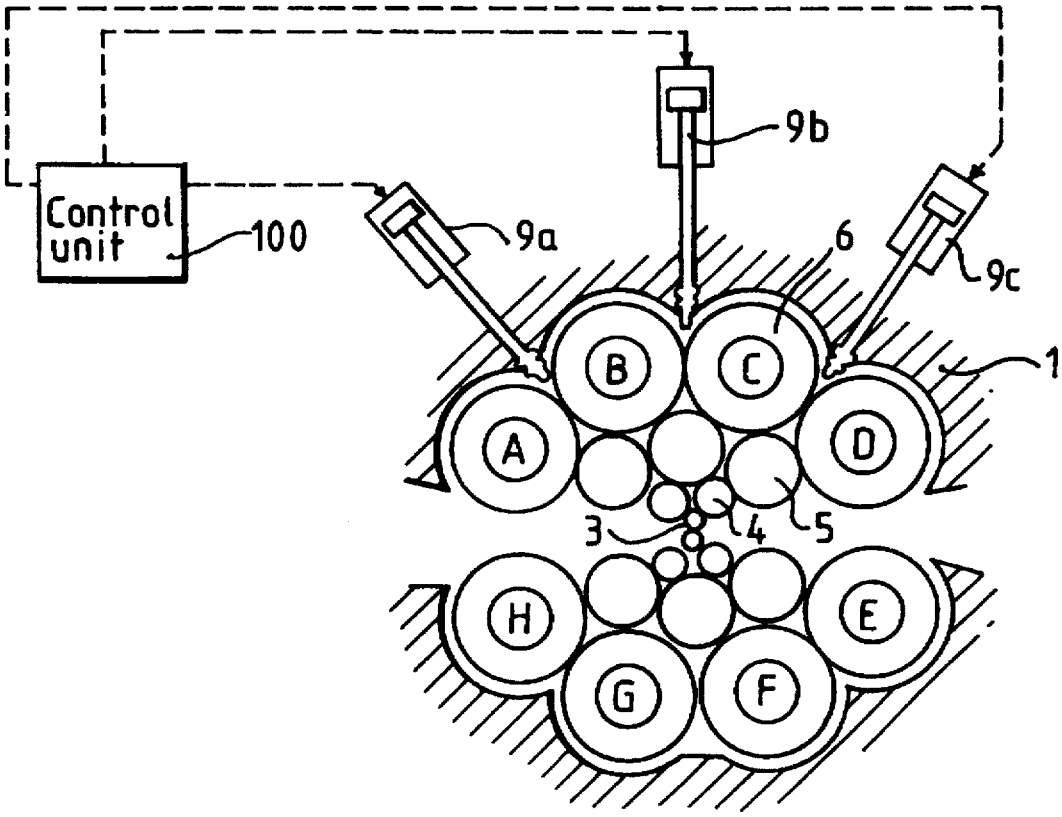
FIG. 2 is a diagrammatic sectional view, in a plane parallel to the direction of movement of the strip, of Sendzimir rolling mill to which the invention is applied.
Figure 5:
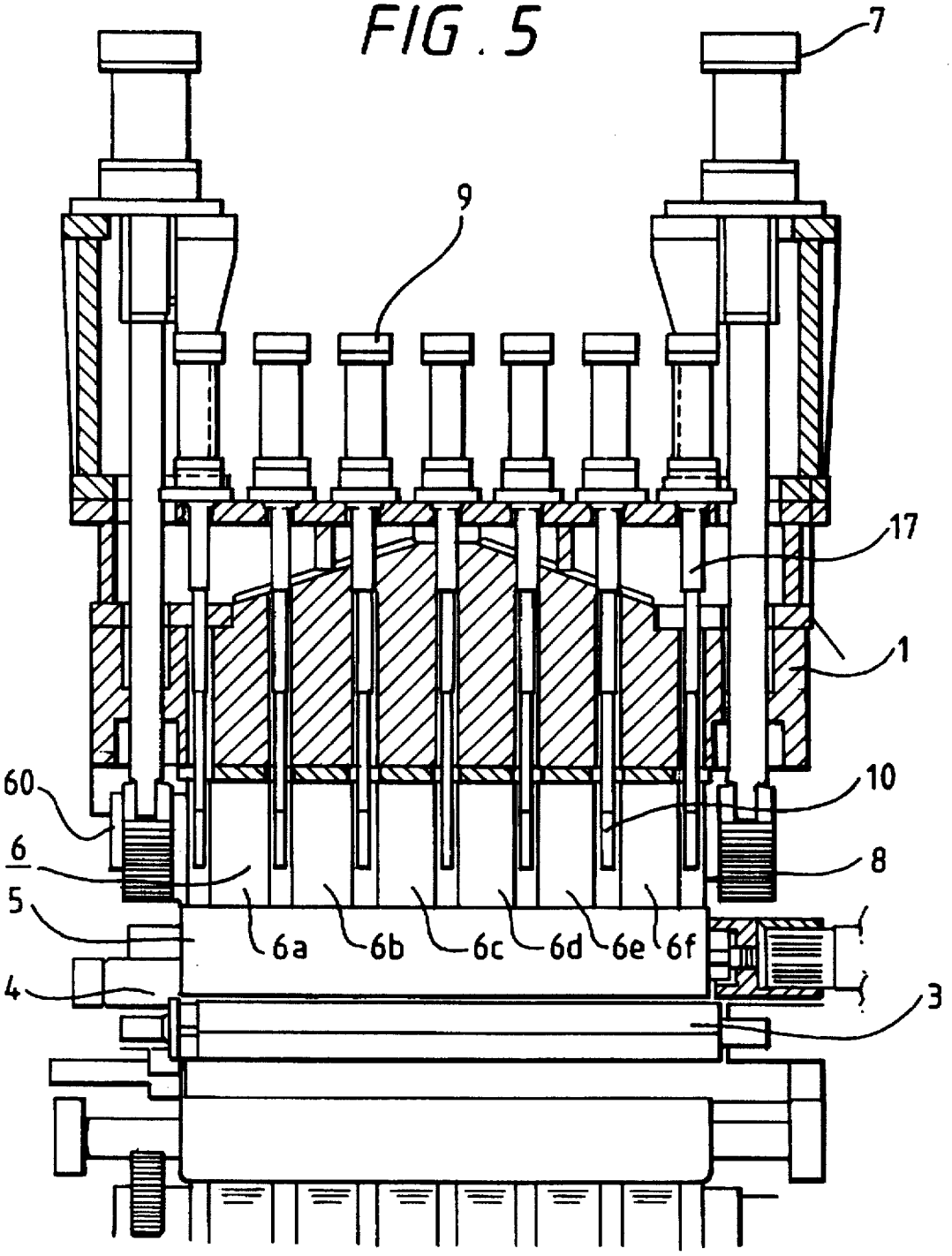
FIG. 5 is a vertical section, at the mill center plane, of a Sendzimir mill to which the invention can be applied.

FIG. 2 shows a conventional arrangement of rolls, in a twenty high Sendzimir mill. The small diameter work rolls 3 are each supported by a pair of first intermediate rolls 4, and the first intermediate rolls 4 are supported by three second intermediate rolls 5. The second intermediate rolls 5 are in turn supported by four backing bearing assemblies 6 labelled clockwise A, B, C, D at the upper side of the mill and E, F, G, H at the lower side of the mill. Each backing bearing assembly 6 comprises as is known a plurality of individual backing bearings mounted on a common shaft and spaced axially along the second intermediate rolls 5. Typically there are six such backing bearings 6a to 6f as seen in FIG. 5 to be described later. The position of the shaft of the backing bearing assembly 6 can be adjusted relative to the mill pass line by a coarse adjusting mechanism which operates on the ends of the shaft and is described more below. Secondly, individual fine adjustment mechanisms in the form of strip shape control means are provided along the shaft so that each of the backing bearings 6a to 6f, may be individually set so as to exert together a shape control pattern to the work roll, through the intermediate rolls 4,5. As mentioned, these adjustment mechanisms are operable during rolling, and are known as AS-U devices, which term will be used below sometimes.

FIG. 2 shows an embodiment of the invention in which three backing bearing adjustment mechanisms 9a, 9b and 9c are indicated, under control of a control unit 100. The adjustment mechanism 9a controls the operation of the backing bearing assembly A, while the adjustment mechanism 9c controls the backing bearings of the backing bearing assembly D. The control mechanism 9b controls the two backing bearing assemblies B, C in conjunction, so that, as is already known, a corresponding pair of the backing bearings of the assemblies B, C respectively are adjusted simultaneously and in concert.

Thus FIG. 2 shows an embodiment in which all four of the backing bearing assemblies on the upper side of the mill have adjustment mechanisms (AS-U devices) and can be adjusted during rolling of the strip in order to provide a required shape control pattern. The outermost pair of backing bearing assemblies A, D are each controlled independently, and the topmost pair, B, C are adjustable in conjunction and independently of the assemblies A, D.

In an alternative arrangement, according to the invention, illustrated in FIG. 12, the backing bearing assemblies A and B are controlled for applying a desired shape control pattern by a single adjustment mechanism 9a (AS-U device) and similarly the backing bearing assemblies C, D are also controlled by a second adjustment mechanism 9b. As in FIG. 2, all four of the backing bearing assemblies above the strip are controlled, in this case in two independent pairs.

In known twenty high mills AS-U devices for adjusting shape control patterns have been installed only in the topmost two backing bearing assemblies B,C or in the outermost two backing bearing assemblies A,D and have not been operated independently. The effect of the embodiment of the invention shown in FIG. 2 is to expand the capability of the mill to apply shape control both quantitatively and qualitatively. Table 1 below shows the distribution of the rolling load P to the backing bearing assemblies 6. Reference here should be made to FIG. 10 of the accompanying drawings which shows how the individual loads $P_A$, $P_B$, $P_C$ and $P_D$ at the respective shafts of the four backing bearing assemblies are arrived at from the path of the forces through the roll cluster. The particular example of Table 1 is for a ZR21AN type mill, with backing bearing diameter of 406 mm and two different work roll diameters of 80 mm and 65 mm.

TABLE 1

| Work Roll Diameter | 80 mm | 65 mm |
|---|---|---|
| Rolling load (P) | 100% | 100% |
| A, D shaft support load ($P_A$, $P_D$) | 55% | 60% |
| B, C shaft support load ($P_B$, $P_C$) | 45% | 40% |

Because of symmetry, the load distribution is the same between the backing bearing assemblies A and D and similarly the same between the assemblies B and C. The amount of the adjustment movement of the individual backing bearings of each backing bearing assembly is limited by the permissible amount of bearing mark and also from considerations of life, as well as from design limitations. The effect of the adjustment of each backing bearing assembly on the deflection of the work roll is proportional to the distribution of the rolling load to the backing bearing assembly, according to the principle of conservation of energy. Based upon the load distributions shown in Table 1, the effect on the deflection of the work roll for a conventional device in which only backing bearing assemblies B and C are capable of shape control adjustment, and the embodiment of FIG. 2 can be compared in the following Table 2.

TABLE 2

| Effect of shape control adjustment at roll bite | | |
|---|---|---|
| Work roll diameter | 80 mm | 65mm |
| Relative effect at roll bite | | |
| Control at B, C only | 45% | 40% |
| Control at A, B, C, D | 100% | 100% |

Table 2 thus shows that compared with the conventional mill in which control is effected only at backing bearing assemblies B, C, the arrangement of FIG. 2 provides a shape control capacity of 2.2 times greater (at work roll diameter 80 mm) or 2.5 times greater (at work roll diameter 65 mm). Furthermore, almost the same shape control capacity (100%) is available at both work roll diameters, whereas in the conventional device the shape control capacity decreases from 45% with a work roll diameter of 80 mm to 40% with a work roll diameter of 65 mm.

The shape control in the invention is also enhanced qualitatively, since finer adjustment may be achieved. Using two independently adjustable bearing assemblies permits this, and further such benefit can be obtained by staggering the locations of the backing bearings in the axial directions of the respective shafts of the backing bearing assemblies A and B, and likewise staggering the backing bearings on the respective shafts of the backing bearing assemblies C and D.

Referring now to FIG. 11, this shows the deflection of the work roll in a typical twenty high Sendzimir mill. The work roll 3 is first bent at the edge of the strip 2 by the first intermediate roll 4, but this bending at an edge can be prevented by positioning the taper edge of the first intermediate roll 4 near the strip edge part. The second intermediate roll 5 is supported by the backing bearings and is deflected less, but in the contact area there is a spring effect due to Hertz flattening. The work roll 3, first and second intermediate rolls 4, 5 are extremely small in diameter as compared with the diameter of the ordinary work roll of a four high rolling mill, and even the largest second intermediate roll has less than half the diameter of the latter. Therefore, bending action occurs in the second intermediate roll 5 at the outer side of the strip width, and the second intermediate roll 5 is deflected in a curve of higher order than a quadratic curve taking the mill center to be the origin, and therefore the work roll 3 is deflected through the first intermediate roll 4. It is hence necessary to correct the deflection of the second intermediate roll 5. Incidentally, in the twenty high rolling mill with the strip width of about 1200 mm, the diameter of the second intermediate roll 5 is about 200 mm, and in this case the axial deflection of the second intermediate roll 5 is nearly expressed by a quadratic curve, centering on the point approximately spaced from the strip edge to the middle by the distance of 1.5 times the roll diameter. That is, in the case of strip width of 1200 mm, this center is 200×1.5=300 mm from strip center and taking the strip center as the origin, this characteristic is nearly the same as the curve of the fifth power. Therefore, the deflection of the second intermediate roll 5 must be corrected and controlled by shape control applied by the backing bearings (AS-U) but since the strip width varies, it is desired that the start points of AS-U can be set continuously as much as possible. However, for reasons of strength and design, the number of backing bearings in one row cannot be increased. The number of sections of bearing allowed in a rolling mill with a maximum strip width of 1200 mm is about six. Therefore, the control pitch is about 200 mm, which is large and discontinuous.

In the multiroll rolling mill of the invention, for example, by staggering the shape control (AS-U) action points of the backing bearings of the A, D shafts 100 mm each with respect to those of the B, C shafts, a fine shape control adjustment capability with 100 mm pitch is realized, since the backing bearings A, D are adjustable independently of the backing bearings B, C. Thus deflection of the second intermediate roll 5 can be corrected more accurately regardless of the strip width. In this way the qualitative effect of the AS-U control is enhanced.

Figure 3:
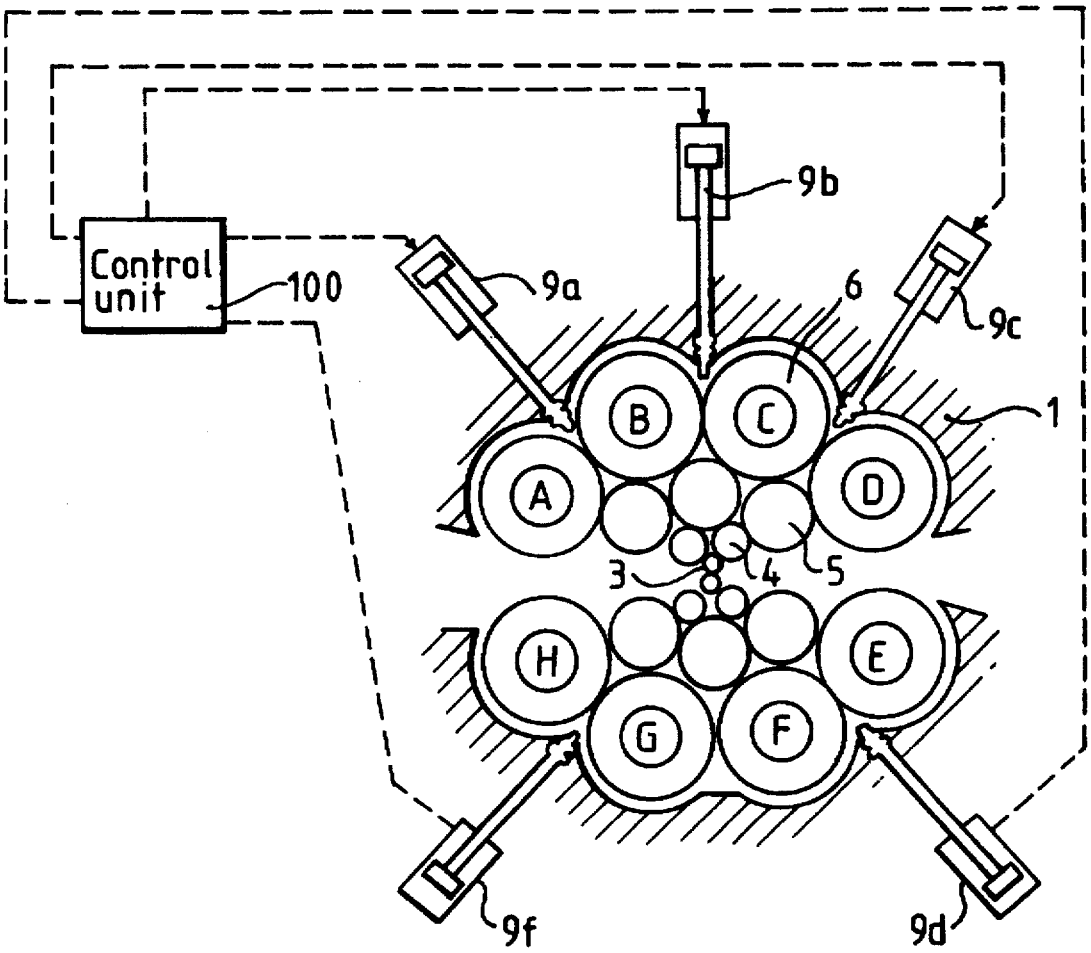
FIG. 3 is a diagrammatic sectional view similar to that of FIG. 2, showing another embodiment of a Sendzimir mill to which the invention is applied.

FIG. 3 shows a further embodiment of the invention in which, as in FIG. 2, all of the backing bearing assemblies A, B, C, D have shape control adjustment through the adjustment mechanisms 9*a*, 9*b* and 9*c* as already described, and additionally the two outermost backing bearing assemblies E, H at the lower side of the mill have independent shape control adjustment capability through shape control adjustment mechanisms 9*d* and 9*f*.

Figure 4:
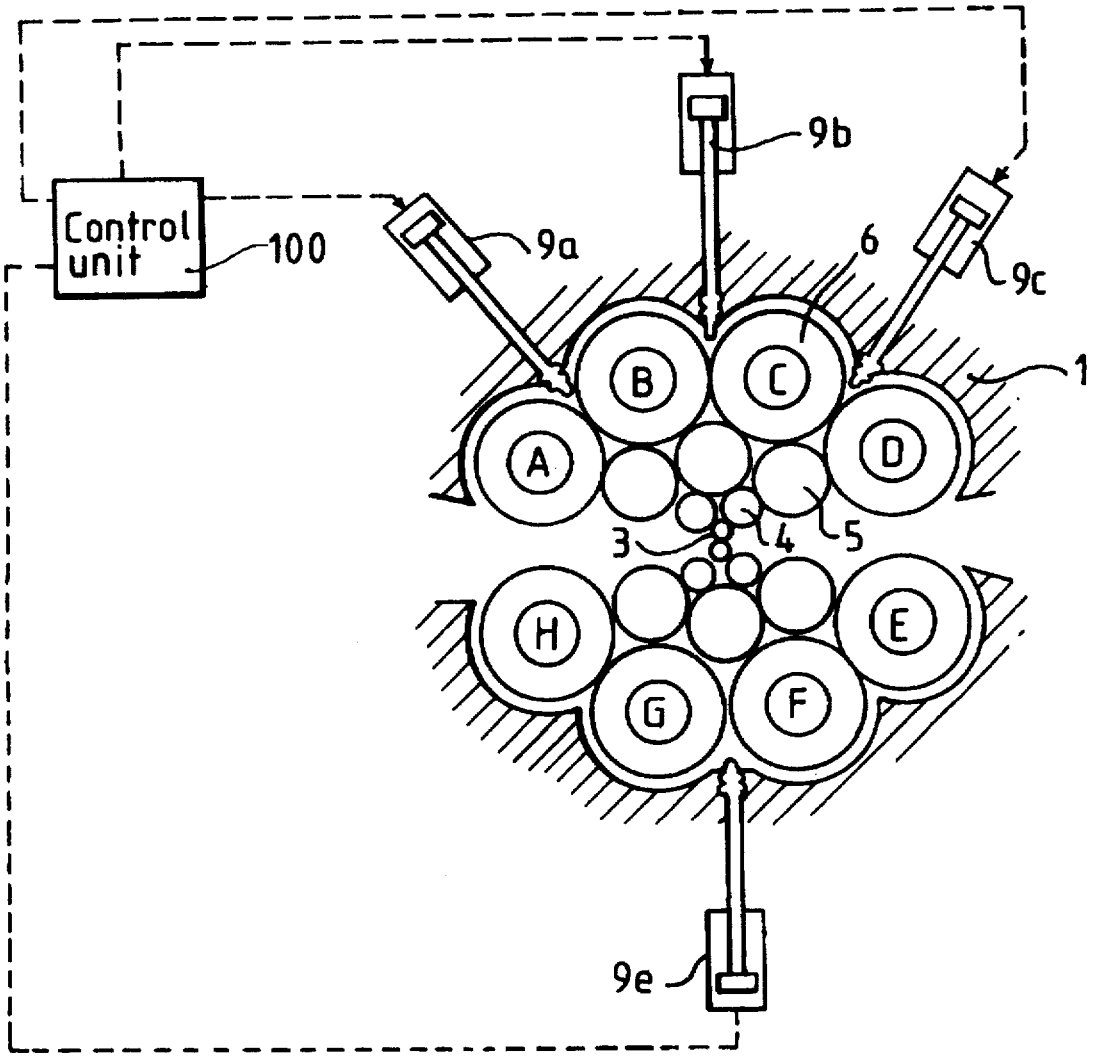
FIG. 4 is a further diagrammatic sectional view, similar to that of FIG. 2, showing yet another embodiment of a Sendzimir mill to which the invention is applied.

FIG. 4 illustrates another alternative embodiment in which again all the upper four backing bearing assemblies A, B, C, D are controlled for shape control adjustment, as in FIG. 2, and additionally the two lowermost backing bearing assemblies F, G at the lower side of the mill have shape control capability through a bearing adjustment mechanism 9*e* which operates on the bearings of the assemblies F, G in conjunction, i.e. these backing bearing assemblies are controlled, for shape control adjustment, in the same way as the backing bearing assemblies B, C.

FIGS. 2 to 4 thus illustrate the principles of the invention. Details of the backing bearing assemblies and their adjustment mechanisms are now given, and reference may also be made by the expert to the prior art discussed above and also existing mill practice.

FIG. 5 is a section on the plane of the center axis of the work rolls 3 and shows also the shaft 60 of one backing bearing assembly 6 on which the bearing units 6*a* to 6*f* are mounted. At the axial ends of the shaft 60 are screwdown gears 8, by which coarse adjustment of the position of the shaft 60 is achieved through screw-down cylinders 7 (see FIGS. 9(A) and 9(B)). The shape control mechanism, which adjusts the position of each bearing 6*a* to 6*f*, i.e. by applying a bending force to shaft 60, comprises a plurality of adjustment cylinders 9 connected through rods to respective eccentric mechanisms 10 which are also described below.

FIGS. 6 to 9 illustrate the screwdown control mechanism operated by the screwdown cylinders 7 and the shape control adjustment mechanism for each bearing 6*a* to 6*f*, operated by the cylinders 7. These figures show portions of the adjustment mechanisms actuating the topmost backing bearing assemblies B, C and do not show any corresponding mechanisms for the backing bearing assemblies A and D, but, according to the invention, these are provided in an analogous manner, although the mechanisms for the assemblies A and D adjust only a single assembly, whereas that for assemblies B and C adjust both assemblies. Furthermore, to aid understanding FIG. 8 illustrates the case where there is no adjustment of the backing bearings, and only the screwdown adjustment, i.e. there is only a single eccentric adjusting ring on the shaft 60.

Looking first therefore at FIG. 8(B), there can be seen an eccentric ring 19 which supports the shaft 60 in a supporting saddle 20 of the assembly. The ring 19 is rotatable around the shaft 60 in the saddle 20, so that its rotational position determines the location of the axis of the shaft 60. The backing bearing 6*a* and the other bearings 6*b*–6*f* not seen here are mounted directly on the shaft 60. Rotation of the ring 19 is achieved by the adjacent ring 11 fixed to the ring 19. The ring 11 has a toothed sector which meshes with a rack 8 (FIG. 6) driven vertically (in this example) by the screwdown cylinder 7. The degree of screwdown eccentricity is considerable, being represented by the space between the respective centers $C_c$ of the bearing shaft 60 and $C_s$ of the saddle supporting surface seen in FIG. 8(A).

Referring now to FIG. 9, this illustrates a combination of screwdown adjustment for the shaft 60 and fine adjustment means for the individual backing bearings. As can be seen, adjacent each backing bearing unit are two fine adjustment eccentric rings 21, for effecting fine adjustment of the position of the axis of the shaft 6 at that backing bearing. Thus at the left hand side of the endmost backing bearing 6*a* shown in FIG. 9(B), there can be seen two eccentric rings 19, 21 also illustrated at the right hand side of FIG. 9A. The first of these effects the coarse screwdown adjustment as described above, and the second ring 21 effects the fine shape control adjustment. Rolling bearings 22 are shown separating these rings from each other and from the saddle 20.

Figure 6:
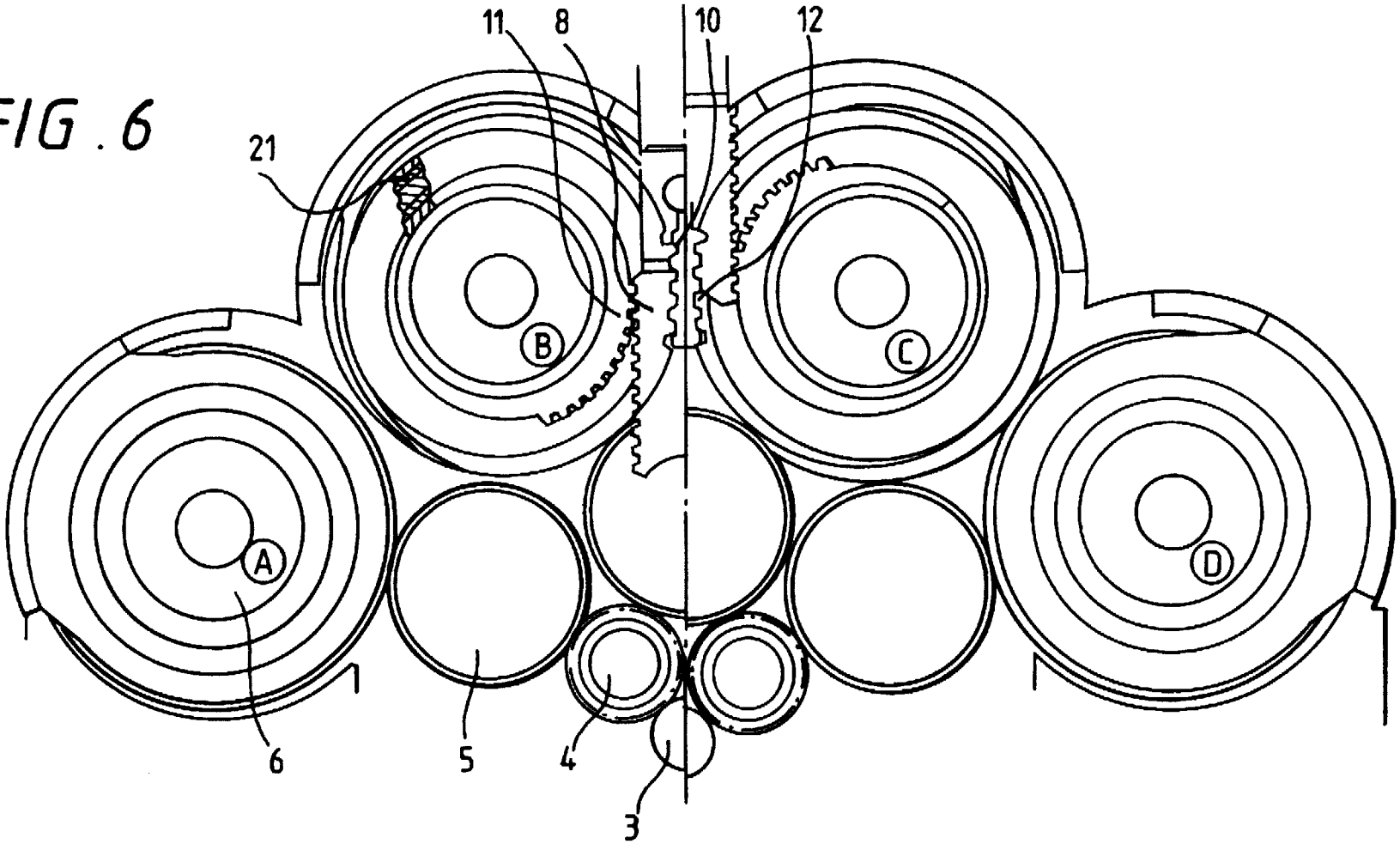
FIG. 6 is a diagrammatic side view of a roll cluster at one side of the rolling path, in a Sendzimir mill to which the invention may be applied.

As FIG. 6 shows, the fine adjustment eccentric ring 21 has a toothed sector 12, which meshes with a rack 10 at the end of a rod connected to the adjustment piston 9. Operation of the piston 9 causes rotation of the ring 21 through the rack 10 and toothed sector 12 to cause fine adjustment of the position of the axis of the shaft 60 at the location of the relevant backing bearing. FIG. 5 shows, as described, that each adjustment mechanism for the backing bearings is operated by a piston 9, there being seven such pistons and adjustment mechanisms for the six backing bearings 6*a* to 6*f*. Each backing bearing 6*a* to 6*f* has, at its axial ends, a pair of the adjustment rings 21.

Figure 7:
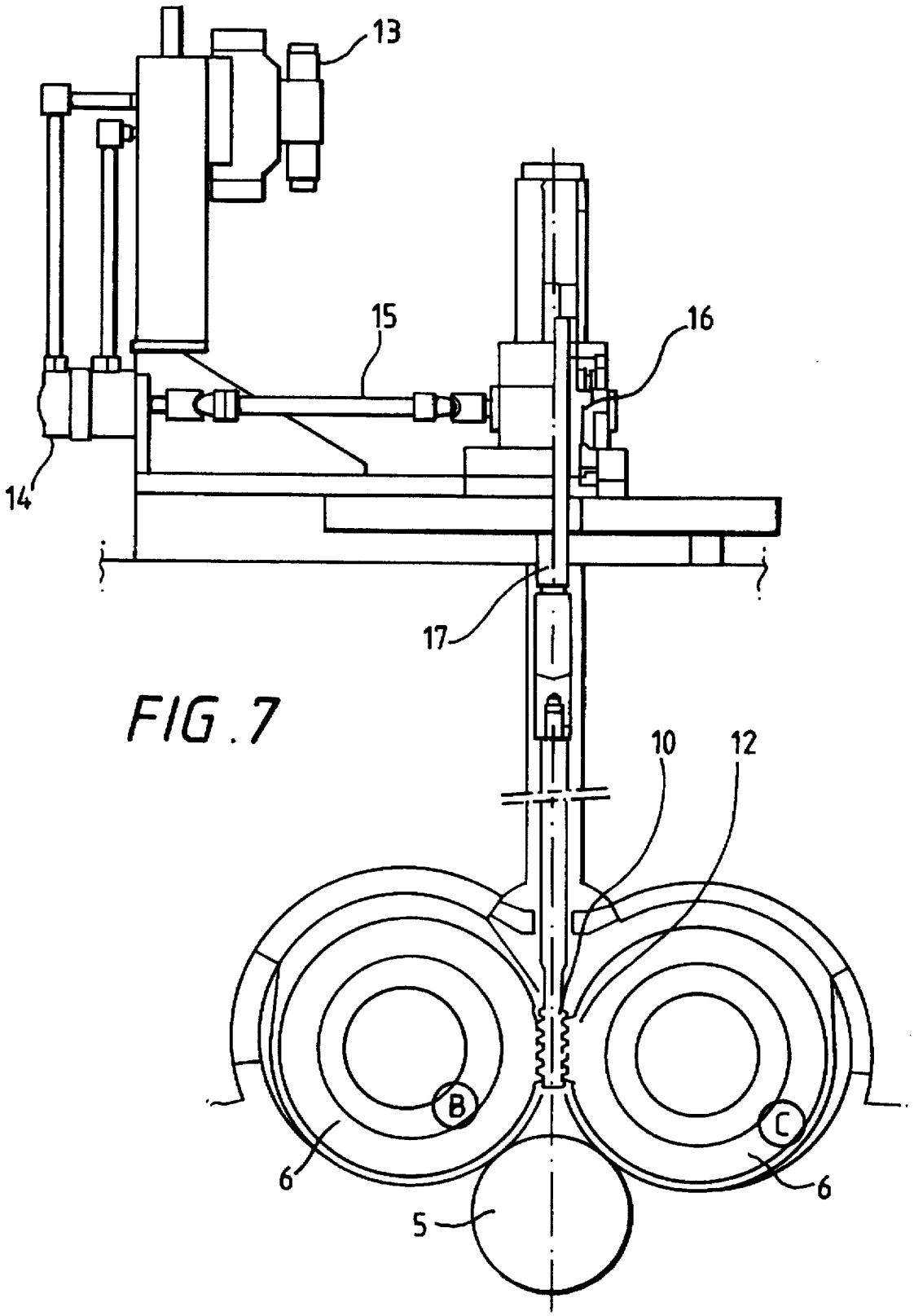
FIG. 7 is a further diagrammatic view illustrating the shape control adjusting mechanism applicable to the construction of FIG. 6.

An alternative embodiment of the control mechanism of the rings 21 is shown in FIG. 7 in which the rack 10 is moved by a driving system comprising a vertical rod 17 connected to the rack 10 and driven vertically in the manner of a lead screw by a central screw thread on a worm gear wheel mounted in a worm drive mechanism 16. The worm gear wheel is driven at its periphery by a worm which in turn is driven by a shaft 15 driven by a hydraulic motor 14 under control of an electromagnetic directional valve 13.

FIG. 6 illustrates how the racks 8 and 10 have toothing on both sides, meshing with the respective toothed sectors 11 and 12 of both the backing bearing assemblies B and C.

FIG. 9(A) shows the respective centers of the respective circles making up the eccentric system. $C_c$ is the center of the bearing shaft and $C_s$ is the center of the saddle supporting surface. $C_a$ is the center of the eccentric ring 21. FIG. 9(A) illustrates the AS-U eccentricity $C_a$ i.e. the amount of fine control of the position of the backing bearing unit, which is used to effect shape control of the rolled strip.

Referring again to FIG. 8, it will be noted that the screwdown component force on the bearing 6*a* acts on the screwdown eccentricity $E_s$, to generate a moment tending to rotate the shaft 60, but since there is metal contact between the screw-down eccentric ring 19 and the shaft 60, such rotation of the shaft 60 can be prevented due to self-locking by the friction at the metal contact surfaces.

As mentioned, in FIG. 9 the eccentric ring 21 is supported by the shaft 60 on the saddle 20 through needle bearings 22 in order to reduce the friction resistance enabling operation of the adjustment device 9 during rolling. With the provision of the needle bearings, there is no metal-metal contact as in FIG. 6, so that there is no self-locking against rotation of the shaft 60 under the screw-down component force. This problem is solved by braking means described below.

FIG. 12 illustrates schematically the case already described above, where two shape control adjustment mechanisms 9 are provided, respectively operating upon the backing bearings of the backing bearing assemblies A and B on the one hand and C and D on the other hand. Both these adjustment mechanisms 9*a* are constructed as described above for the adjustment mechanism 9*b* which effects simultaneous and uniform control of two backing bearing assemblies.

The embodiment of FIG. 12 permits a wide variety of control of shape, by independent adjustment of the two pairs of backing bearing assemblies A and B on the one hand and C and D on the other hand. It must be remembered that the effect of individual backing bearings, using the adjustment mechanism 9 is very small, and large variations of roll diameter, for example, are accommodated by means of the screwdown adjustment. This fine control of the individual backing bearing units permits a very favorable characteristic for fine control of the strip shape, even in automatic control of the strip shape during rolling.

FIGS. 13 and 14 illustrate a braking mechanism applicable acting upon the outermost backing bearing assemblies A and D, in the embodiment of FIG. 12. As mentioned, the rolling force tends to rotate the shaft 60 due to the screw-down eccentric amount $E_c$ (see FIG. 8(A)). The construction of FIGS. 13 and 14 brakes the shaft 60 against such rotation, and may also be applied, for example, to backing bearing assemblies E and H in the lower part of the mill. FIGS. 13 and 14 show a braking cylinder 27 pivotally mounted in the mill frame and having a piston rod 27*a* connected to a pin 26 eccentrically fixed on a rotating gear 25. The gear 25 meshes with the ring 11 fixed to the eccentric ring 19 which provides the coarse adjustment of the position of the shaft 60, in the manner described above. Through the gear 25, pin 26 and rod 27*a*, the tendency of the shaft 60 to rotate under the screw down force is resisted by fluid in the cylinder 27. While rotation of the ring 19 can be permitted when desired, by control of the cylinder 27, this construction provides sufficient resistance to prevent unwanted rotation of the shaft 60.

FIGS. 15 to 17 show the braking mechanism and details of the shape control adjustment mechanism 9 for the backing bearing assemblies A and D, in the embodiment illustrated by FIG. 12 where the backing bearing assemblies A and B on the one hand and C and D on the other hand are operated in conjunction by respective shape control adjustment mechanisms. The rod 17 connecting the adjustment cylinder 9 to the rack 10 in each adjustment mechanism extends obliquely into the housing 1 of the mill and is guided by a bush 28. The position of the adjustment mechanism at any time can be monitored by means of a position detector 29.

FIG. 18 shows the effect of the control of strip crown (strip shape) at the location of the work roll. FIG. 18A shows the effects obtainable when the backing bearing assemblies B and C have shape control adjustment, while FIG. 18(B) shows the case where in accordance with the invention, all of the shafts A to D have shape control adjustability, the shafts A and B being controlled in conjunction with each other and the shafts C and D being controlled in conjunction with each other, i.e. the arrangement illustrated by FIG. 12. It can be seen that the effect at the work roll can be much greater in the case of FIG. 18(B) and also that the possibilities for variation of shape control are greater. In the case of FIG. 18(A), diagram (a), the permissible value of the positional difference between adjacent backing bearings in the axial direction of the rolls is limited within a certain range (1) from considerations of the bending stress on the shaft 60 or from considerations of the production of bearing marks on the product. This limits the total amount of strip crown which can be formed. On the other hand in diagram (a) of FIG. 18(B), the amount of crown which can be applied is greatly expanded. Diagram (b) show how the shape control applied by the shafts A and B on the one hand and C and D on the other hand can be combined to create various possible roll curves, improving the qualitative nature of the shape adjustment. Diagram (c) show levelling effects which can be obtained. In a monoblock cluster mill, levelling of the work roll on the operation side and the driving side is achieved only by the shape control adjustment devices. Therefore in the case of FIG. 18(A), when the levelling and shape correction are employed simultaneously, the possibilities for shape control are significantly limited. In the present invention, however, the levelling effect can be obtained by one shape control adjustment device and shape control by another such device, permitting independent control of these two effects.

A further possibility within the invention to achieve finer control of the strip shape is to stagger the backing bearings of two adjacent backing bearing assemblies, in the axial direction of the rolls. This is illustrated by FIG. 19, for the case corresponding to FIG. 2 where three shape control adjustment mechanisms 9 are provided operating respectively the bearing assembly A, the bearing assemblies B and C and the bearing assembly D. FIG. 19 illustrates how the six backing bearings of the assemblies B and C are staggered relative to the five backing bearings of the shafts A and D. This permits a control pattern with effectively half the pitch of the backing bearings, and qualitative control is further improved. Furthermore, the risk of production of bearing mark transfer to the rolled strip is reduced.

The invention has principally been illustrated by the reference to twenty high mills, and mainly to the upper rolls of such mills, but it will be apparent to those skilled in this art that the same principles can be applied to twelve high mills or other cluster mills, and also that the invention can be applied to the lower rolls of such mills.

What is claimed is:

1. A strip rolling mill of cluster type having, on at least one side of a strip path, a work roll, a plurality of intermediate rolls supporting said work roll and a plurality of backing bearing assemblies supporting said intermediate rolls and each assembly comprising a row of backing bearing units extending parallel to a work roll axis, wherein each said backing bearing assembly on said one side of the strip path has shape control means for strip shape control applying a shape control pattern to said work roll, said shape control means consisting of a plurality of shape control devices by which said backing bearing units are individually adjustable relative to the work roll axis to apply shape control to said work roll, and wherein said mill has means for applying different shape control patterns to said work roll by applying different forces to respective different ones of said backing bearing assemblies, said means for applying different patterns including at least two of said shape control means which are independently operable so as to apply respectively different shape control patterns to said work roll.

2. A strip rolling mill according to claim 1, wherein said two independently operable shape control means belong to two adjacent ones of said backing bearing assemblies, one of which is more remote from a mill center plane than the other.

3. A strip rolling mill according to claim 1, wherein said backing bearing units of two adjacent ones of said backing bearing assemblies are axially staggered relative to each other.

4. A strip rolling mill according to claim 1, wherein each said backing bearing assembly further has a rotatable shaft carrying thereon said backing bearing units, at least one of said backing bearing assemblies having position adjustment apparatus for commonly adjusting said backing bearing units carried by said rotatable shaft relative to the work roll axis, and each of said backing bearing assemblies being free of such position adjustment apparatus has braking apparatus for selectively preventing said shaft from rotating by mill rolling forces.

5. A strip rolling mill according to claim 1, wherein one of said at least two said shape control means forms one shape control pattern by said backing bearing units of one of said backing bearing assemblies, another of said at least two said shape control means forms another shape control pattern by said backing bearing units of another of said backing bearing assemblies, and said one and another shape control patterns are different from each other and applied to said work roll to provide a roll gap according to a combined shape control pattern.

6. A strip rolling mill according to claim 1, wherein at least one of said backing bearing assemblies having said shape control means has a shaft supporting said backing bearing units and a first rotatable toothed sector secured to said shaft, said shaft being selectively braked by a braking apparatus, said braking apparatus comprising said first rotatable toothed sector, a second rotatable toothed sector which is rotatable around an axis thereof being meshed with said first rotatable toothed sector, and a piston-and-cylinder unit having a piston rod pivotally connected to said second rotatable toothed sector, rotation of said shaft being braked by said piston-and-cylinder unit.

7. A strip rolling mill according to claim 1, wherein said respective different ones of said backing bearing assemblies engage respective different ones of the intermediate rolls.

8. A strip rolling mill according to claim 3, wherein said respective different ones of said backing Rearing assemblies engage respective different ones of the intermediate rolls.

9. A strip rolling mill according to claim 4, wherein said braking apparatus comprises a first rotatable toothed element fixed on said shaft, a second rotatable toothed element meshing with said first rotatable toothed element and a piston-and-cylinder unit connected to said second toothed element to selectively resist rotation thereon.

10. A strip rolling mill of cluster type having, on at least one side of a strip path, a work roll, a plurality of intermediate rolls supporting said work roll and a plurality of backing bearing assemblies supporting said intermediate rolls and comprising a row of backing bearing units extending parallel to a work roll axis, there being on said one side of the strip path at least three such backing bearing assemblies of which two are remote from a mill center plane on opposite sides thereof and at least one is closer to the mill center plane than said two remote ones, wherein at least one of said two remote backing bearing assemblies and said closer backing bearing assembly have respective shape control means, each including a plurality of shape control devices, by which the backing bearing units thereof are individually adjustable relative to the work roll axis to apply shape control to said work roll, said respective shape control means being independently operable so as to apply different shape control patterns to said work roll by applying different forces to respective different ones of said backing bearing assemblies.

11. A strip rolling mill according to claim 10, wherein said backing bearing units of said at least one closer backing bearing assembly are axially staggered relative to said backing bearing units of at least one remote backing bearing assembly.

12. A strip rolling mill according to claim 10, wherein said respective different ones of said backing bearing assemblies engage respective different ones of the intermediate rolls.

13. A strip rolling mill of cluster type having, on at least one side of a strip path, a work roll, a pair of first intermediate rolls supporting said work roll, three second intermediate rolls supporting said first intermediate rolls and four backing bearing assemblies supporting said second intermediate rolls, said backing bearing assemblies being in two pairs on opposite sides of a mill center plane, each pair having a first said assembly close to said plane and a second said assembly further from said plane than said first assembly, and each comprising a row of backing bearing units extending parallel to a work roll axis, wherein each of said four backing assemblies has strip shape control means consisting of a plurality of strip shape control devices for individually adjusting positions of said backing bearing units thereof relative to the work roll axis to apply shape control to said work roll, said shape control means of said two first backing bearing assemblies being linked so that their backing bearing units are adjusted in conjunction to apply a shape control pattern to said work roll by applying a force to said two first backing bearing assemblies, and said shape control means of said second backing bearing assemblies being operable independently of said shape control means of said first backing bearing assemblies to apply a different shape control pattern to said work roll by applying a different force to said second backing bearing assemblies.

14. A strip rolling mill of cluster type having, on at least one side of a strip path, a work roll, a pair of first intermediate rolls supporting said work roll, three second intermediate rolls supporting said first intermediate rolls and four backing bearing assemblies supporting said second intermediate rolls, said backing bearing assemblies being in two pairs on opposite sides of a mill center plane, each said pair having a first said assembly close to said plane and a second said assembly further from said plane than said first assembly, and each of said four backing bearing assemblies comprising a row of backing bearing units extending parallel to a work roll axis, wherein each of said four backing bearing assemblies further has strip shape control means consisting of a plurality of shape control devices for individually adjusting positions of the backing bearing units thereof relative to the work roll axis to apply shape control to said work roll, said shape control means of said first and second backing bearing assemblies in each said pair thereof being linked so that their backing bearing units are adjusted in conjunction so as to apply a shape control pattern to said work roll, and said shape control means of the two said pairs being independently operable so as to apply different shape control patterns to said work roll by applying respectively different forces to each of said two pairs of backing bearing assemblies.

15. A strip rolling mill according to claim 14, and wherein each of said first and second backing assemblies further has a rotatable shaft carrying thereon backing bearing units, said first backing bearing assemblies having position adjustment apparatus for commonly adjusting said backing bearing units carried by said rotatable shafts relative to the work roll axis, and each said second backing bearing assembly being free of such position adjustment apparatus and having braking apparatus for selectively preventing said shaft from rotating by mill rolling forces.

16. A strip rolling mill according to claim 15, wherein said braking apparatus comprises a first rotatable toothed element fixed on said shaft, a second rotatable toothed element meshing with said first rotatable toothed element and a piston-and-cylinder unit connected to said second toothed element to selectively resist rotation thereon.

17. A strip rolling mill of cluster type having, on each side of a horizontal path of movement of strip being rolled, a work roll, a pair of first intermediate rolls supporting said work rolls, three second intermediate rolls supporting said first intermediate rolls and four backing bearing assemblies supporting said second intermediate rolls, said backing bearing assemblies on each side of said path of strip movement being in two pairs on opposite sides of a mill center plane, each said pair having a first said assembly close to said plane and a second said assembly further from said plane than said first assembly, and each of said four backing bearing assemblies on each side comprising a row of backing bearing units extending parallel to a work roll axis, wherein each of said four backing bearing assemblies at the side above said path of strip movement and each of two of said second backing assemblies at the side below said path of strip movement has strip shape control means consisting of a plurality of shape control devices for individually adjusting positions of the backing bearing units thereof relative to the work roll axis to apply shape control to said work roll, at least two of said shape control means being independently operable so as to apply respectively different shape control patterns to said work roll by applying different forces to respective different backing bearing assemblies, while two other of said first backing bearing assemblies at the side below said path of movement do not have such strip shape control means.

18. A strip rolling mill according to claim 17, wherein said respective different ones of said backing bearing assemblies engage respective different ones of the intermediate rolls.

19. A strip rolling mill of cluster type having, on each side of a horizontal path of movement of strip being rolled, a work roll, a pair of first intermediate rolls supporting said work rolls, three second intermediate rolls supporting said first intermediate rolls and four backing bearing assemblies supporting said second intermediate rolls, said backing bearing assemblies on each side of said path of strip movement being in two pairs on opposite sides of a mill center plane, each said pair having a first said assembly close to said plane and a second said assembly further from said plane than said first assembly, and each of said four backing bearing assemblies on each side comprising a row of backing bearing units extending parallel to a work roll axis, wherein each of said four backing bearing assemblies at the side above said path of strip movement and each of two of said first backing assemblies at the side below said path of strip movement has strip shape control means consisting of a plurality of shape control devices for individually adjusting positions of the backing bearing units thereof relative to the work roll axis to apply shape control to said work roll, at least two of said shape control means being independently operable so as to apply respectively different shape control patterns to said work roll by applying different forces to respective different ones of the backing bearing assemblies, while two other of said second backing bearing assemblies at the side below said path of movement do not have such strip shape control means.

20. A strip rolling mill according to claim 19, wherein said respective different ones of said backing bearing assemblies engage respective different ones of the intermediate rolls.

21. A strip rolling mill of cluster type having, on at least one side of a strip path, a work roll, a plurality of intermediate rolls supporting said work roll and a plurality of backing bearing assemblies supporting said intermediate rolls and each backing bearing assembly comprising a row of backing bearing units extending parallel to a work roll axis, wherein at least one of said backing bearing assemblies has a rotatable shaft carrying said backing bearing units, at least one support for said shaft, and position adjustment apparatus for said shaft comprising at least one first eccentric ring around said shaft and mounting said shaft, at least one second eccentric ring rotatably disposed between said first eccentric ring and said support, rotating apparatus for rotating said second eccentric ring around said shaft so as to adjust positions of said shaft relative to said support, and braking apparatus for said shaft resisting rotation of said shaft caused by mill rolling forces, said braking apparatus comprising a first rotatable toothed element fixed on said shaft, a second rotatable toothed element meshing with said first rotatable toothed element and a piston-and-cylinder unit connected to said second toothed element to selectively resist rotation thereon.

22. A strip rolling mill according to claim 21, wherein said piston-and-cylinder unit has a piston rod pivotably connected to said second toothed element between a toothed portion of said second toothed element and an axis thereof around which said toothed element is turnable.

23. A strip rolling mill of cluster type having, on at least one side of a strip path, a work roll, a plurality of intermediate rolls supporting said work roll and a plurality of backing bearing assemblies supporting said intermediate rolls and comprising a row of backing bearing units extending parallel to a work roll axis, wherein at least two adjacent backing bearing assemblies in said one side of the strip path each have shape control means by which said backing bearing units are individually adjustable relative to the work roll axis so that strip shape control can be applied, wherein said shape control means of said two adjacent backing bearing assemblies are independently operable so as to apply respectively different shape control patterns to said work roll by applying different forces to respective different ones of the backing bearing assemblies, said backing bearing units of said two adjacent backing bearing assemblies being staggered relative to each other in an axial direction of said work roll.

24. A method of applying shape control in a strip rolling mill of cluster type having, on at least one side of a strip path, a work roll, a plurality of intermediate rolls supporting said work roll, and a plurality of backing bearing assemblies supporting said intermediate rolls and each assembly comprising a row of backing bearing units extending parallel to a work roll axis, said backing bearing units in at least two of said backing bearing assemblies being adjustable relative to the work roll axis so as to apply strip shape control by individually adjusting said backing bearing units, which method comprises simultaneously applying at least two different shape control patterns to said work roll by independently applying different forces to respective different ones of at least two of said backing bearing assemblies.

25. A method according to claim 24, comprising independently adjusting two of said backing bearing assemblies of which one is more remote from a mill center plane than the other.

26. A method according to claim 24, comprising independently adjusting two of said backing bearing assemblies which are on opposite sides of a mill center plane.

27. A method according to claim 24, wherein said respective different ones of said backing bearing assemblies engage respective different ones of the intermediate rolls.

28. A strip rolling mill of cluster type having, on at least one side of a strip path, a work roll, a plurality of intermediate rolls supporting said work roll and a plurality of backing bearing assemblies supporting said intermediate rolls and each assembly comprising a row of backing bearing units extending parallel to a work roll axis, wherein each said backing bearing assembly on said one side of the strip path has a plurality of adjustable movable backing members engageable with least one of the intermediate rolls to apply a shape control pattern to said work roll, said backing members being individually adjustable relative to the work roll axis to apply shape control to said work roll, and wherein a control system is provided to control movement of the backing members by applying a force to one of said backing bearing assemblies to form a first work roll shape control pattern and to control movement of the backing members by applying a different force to another one of the backing bearing assemblies to form a second work roll shape control pattern that is different from the first work roll shape control pattern.

* * * * *